US006840377B2

(12) United States Patent
Yu

(10) Patent No.: US 6,840,377 B2
(45) **Date of Patent: *Jan. 11, 2005**

(54) STORAGE DEVICE PROVIDED WITH MEANS TO ENABLE USER THEREOF TO FETCH THEREFROM EASILY TURNING PARTS OF HAND TOOL

(75) Inventor: Hong-Chow Yu, Taichung Hsien (TW)

(73) Assignee: Shu-Ju Chen, Taichung (TW)

( * ) Notice: Subject to any disclaimer, the term of this patent is extended or adjusted under 35 U.S.C. 154(b) by 140 days.

This patent is subject to a terminal disclaimer.

(21) Appl. No.: 10/259,134

(22) Filed: Sep. 26, 2002

(65) Prior Publication Data

US 2004/0060838 A1 Apr. 1, 2004

(51) Int. Cl.[7] ..... B65D 85/24

(52) U.S. Cl. ..... 206/377; 206/372; 211/69; 211/70.6; 211/163; 221/80

(58) Field of Search ..... 206/369, 372, 206/373, 377, 379, 381, 443, 804; 211/69, 70.6, 163; 221/80, 81

(56) References Cited

U.S. PATENT DOCUMENTS 3,319,780 A * 5/1967 Russell ..... 312/73
4,930,953 A * 6/1990 Fischer ..... 409/134
5,071,346 A * 12/1991 Domaas ..... 433/77
5,474,182 A * 12/1995 Reney ..... 206/379
5,535,882 A * 7/1996 Liu ..... 206/377
5,595,296 A * 1/1997 Wood ..... 206/363
5,711,428 A * 1/1998 Ho ..... 206/738
6,405,865 B1 * 6/2002 Lin ..... 206/379
6,415,923 B1 * 7/2002 Chen ..... 206/379
6,547,074 B1 * 4/2003 Chen ..... 206/379
6,634,502 B1 * 10/2003 Yu ..... 206/379

* cited by examiner

*Primary Examiner*—Jim Foster
(74) *Attorney, Agent, or Firm*—W. Wayne Liauh

(57) ABSTRACT

A storage device is designed to keep retrievably the turning parts of a hand tool. The device comprises a base, and a rotating seat mounted rotatably on the base. The base is provided with a plurality of urging blocks, each having at least one inclined face. The rotating seat is provided with a series of retaining slots and insertion slots in communication with the retaining slots. The insertion slots are corresponding in location to the urging blocks. The retaining slots are used for keeping the turning parts of the hand tool. The turning parts are caused to move upward along the inclined faces of the urging blocks so as to jut out of the retaining slots at the time when the rotating seat is turned in relation to the base.

6 Claims, 13 Drawing Sheets

STORAGE DEVICE PROVIDED WITH MEANS TO ENABLE USER THEREOF TO FETCH THEREFROM EASILY TURNING PARTS OF HAND TOOL

FIELD OF THE INVENTION

The present invention relates generally to a storage device for keeping a plurality of turning parts of a hand tool for use when needed, and more particularly to the storage device which is provided with means to enable a user thereof to retrieve with ease the turning parts of the hand tool.

BACKGROUND OF THE INVENTION

As shown in FIG. 1A, a prior art storage device comprises a seat 1 and a protective shield 3. The seat 1 is provided in the interior with a plurality of retainers 2 for holding the turning parts of a hand tool, such as screwdriver tips. In order to retrieve a needed tip, the seat 1 is first turned to uncover the needed tip as denoted by the letter "A" in FIG. 1B. The screwdriver tip "A" is then removed from the retainer 2 by exerting pressure on one end of the screwdriver tip "A". It is conceivable inconvenient for a busy worker to fetch a needed screwdriver tip from the prior art storage device as described above.

SUMMARY OF THE INVENTION

The primary objective of the present invention is to provide a rotary storage device comprising a base, a rotating seat, and a cover. The rotating seat is disposed on the base such that the rotating seat turns around a central axis of the base. The rotating seat is provided with a plurality of retaining slots and insertion slots, which are arranged in series such that the insertion slots are in communication with the adjoining retaining slots. The base is provided in the upper side with a plurality of urging blocks corresponding in location to the insertion slots of the rotating seat. The urging blocks are provided with one or two inclined faces. The turning parts of a hand tool are held in the retaining slots of the rotating set. As the rotating seat is turned in relation to the base, the turning parts are pushed by the inclined faces of the urging blocks to jut partially out of the retaining slots, so as to facilitate the fetching of a turning part that is needed.

It is another objective of the present invention to provide a drawer-type storage device comprising a cylindrical hollow housing, and a sliding seat that can be drawn out of the housing and then pushed back into place. The housing is provided in the inner wall with a plurality of urging blocks, each having two inclined faces. The sliding seat is provided with a series of retaining slots and insertion slots in communication with the adjoining retaining slots. The turning parts of a hand tool are held in the retaining slots of the sliding sear. As the sliding seat is drawn out, the turning parts are pushed by the inclined faces of the urging blocks to jut partially out of the retaining slots of the sliding seat to facilitate the fetching of a turning part that is desired.

The features and the advantages of the present invention will be more readily understood upon a thoughtful deliberation of the following detailed description of three preferred embodiments of the present invention with reference to the accompanying drawings.

DETAILED DESCRIPTION OF THE PREFERRED EMBODIMENTS

Figure 1A:
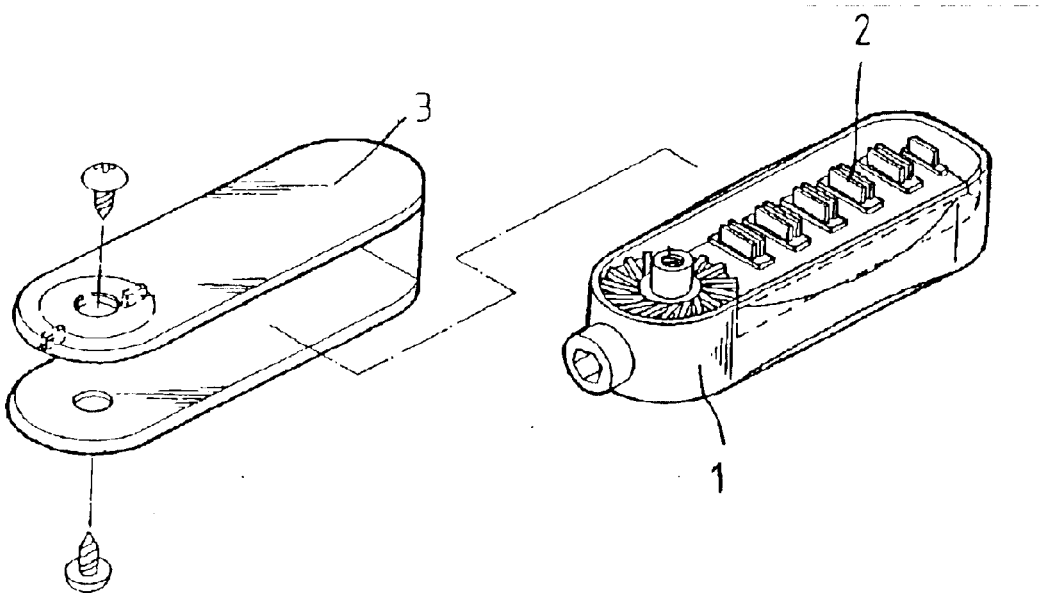
FIG. 1A PRIOR ART
FIG. 1A shows an exploded view of a prior art storage device.
Figure 1B:
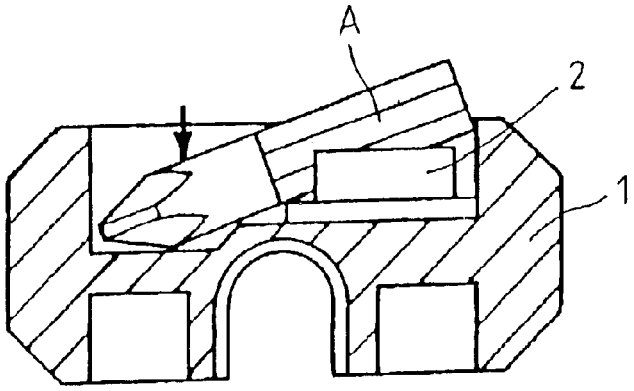
FIG. 1B PRIOR ART
FIG. 1B shows a schematic view of the prior art storage device at work.
Figure 2:
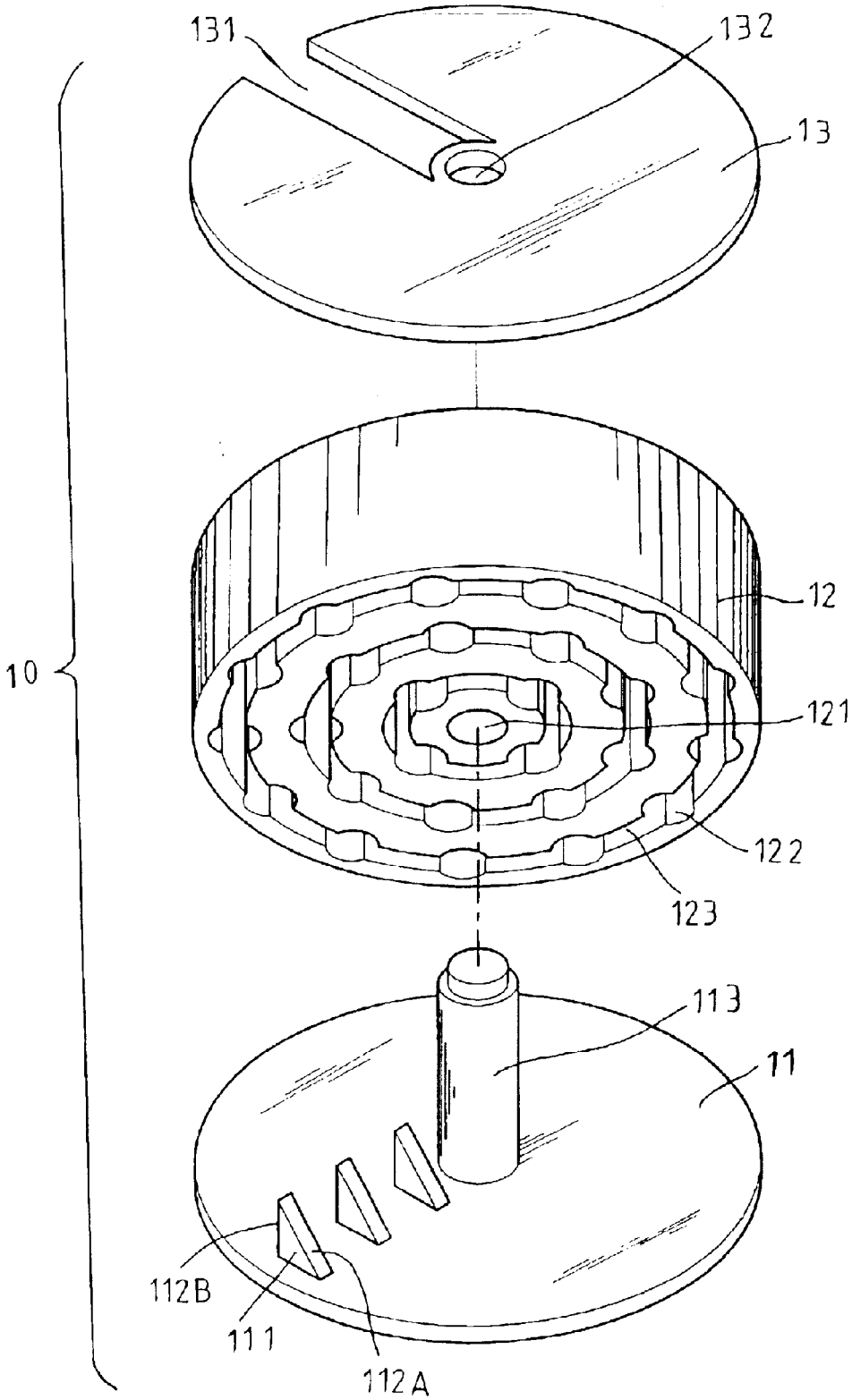
FIG. 2 shows an exploded view of a first preferred embodiment of the present invention.
Figure 3:
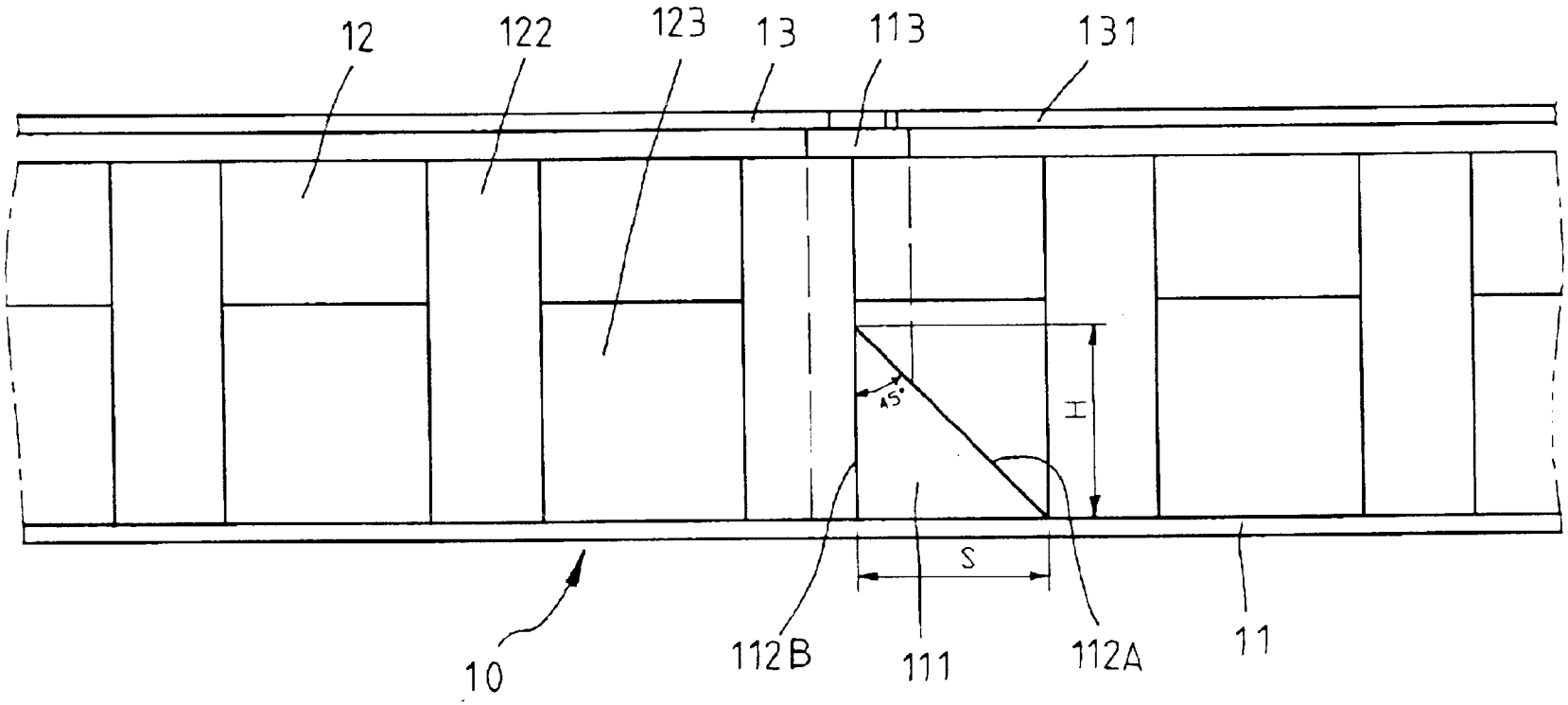
FIG. 3 shows a schematic plan view of a rotating seat of the first preferred embodiment of the present invention.

As shown in FIGS. 2 and 3, a storage device 10 of the first preferred embodiment of the present invention comprises a base 11, a rotating seat 12, and a cover 13.

The base 11 is provided at the center of the upper side thereof with an upright shaft 113 and is further provided in the upper side with a plurality of urging blocks 111, which are arranged at an interval and are provided with an inclined face 112A and a vertical face 112B.

The rotating seat 12 is provided at the center with a shaft hole 121 and is rotatably mounted on the base 11 such that the shaft hole 121 is fitted with the upright shaft 113 of the base 11. The rotating seat 12 is further provided with a plurality of retaining slots 122 and insertion slots 123, which are arranged in series such that the retaining slots 122 alternate with the insertion slots 123, and that the insertion slots 123 are separated from one another by an equal distance "S", as shown in FIG. 3. The insertion slots 123 are corresponding in location to the urging blocks 111 of the base 11.

The cover 13 is provided at the center with a through hole 132 and is rotatably mounted on the rotating seat 12 such that the through hole 132 is fitted with the top end of the upright shaft 113 of the base 11. The cover 13 is further provided with a through slot 131 of a predetermined dimension.

Figure 4C:
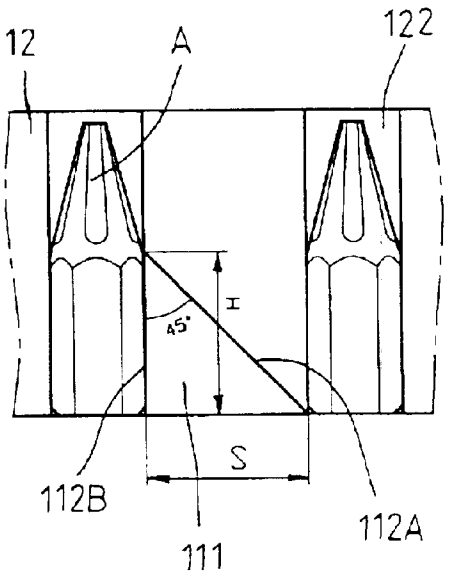
FIG. 4C shows a schematic view of an urging block of the first preferred embodiment of the present invention, with the urging block being provided with an inclined face of 45 degrees.
Figure 4B:
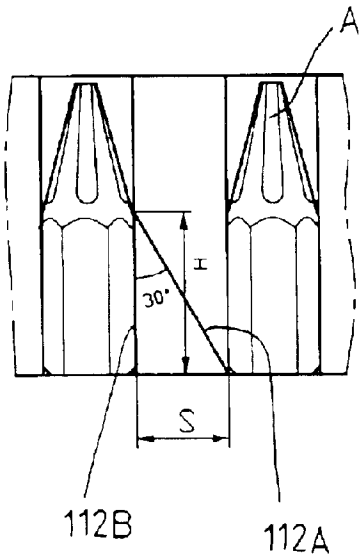
FIG. 4B shows a schematic view of an urging block of the first preferred embodiment of the present invention, with the urging block being provided with an inclined face of 30 degrees.
Figure 4A:
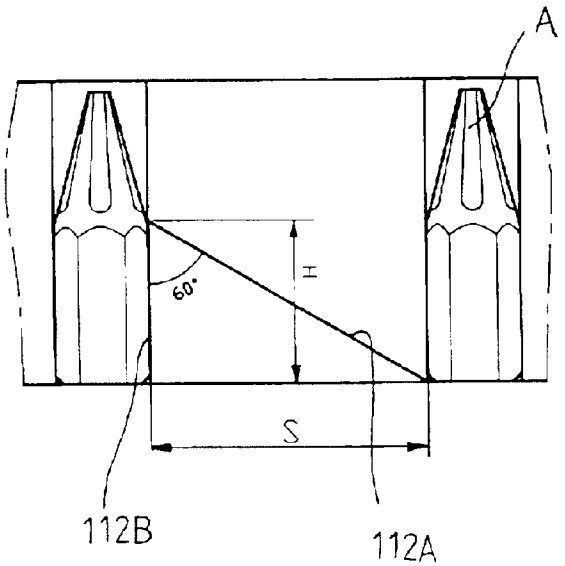
FIG. 4A shows a schematic view of an urging block of the first preferred embodiment of the present invention, with the urging block being provided with an inclined face of 60 degrees.

The inclined face 112A of the urging blocks 111 of the base 11 has an inclination ranging from 30 to 60 degrees, as shown in FIGS. 4A, 4B, and 4C. Preferably, the inclined face 112A has an inclination of 45 degrees. The vertical face 112B of the urging blocks 111 of the base 11 has a height "H". Regardless of the inclination, the vertical faces 112B of all urging blocks 111 are identical in height to one another. In the case of the inclination of the inclined faces 112A being 60 degrees as shown in FIG. 4A, the distance "S" between the two retaining slots 122 of the rotating seat 12 must be greatly increased at the expense of total capacity of the retaining slots 122 of the rotating seat 12. On the other hand, if the inclination of the inclined faces 112A is changed to 30 degrees, as shown in FIG. 4B, the distance "S" between the two retaining slots 122 of the rotating seat 12 can be greatly reduced so as to increase total capacity of the retaining slots 122 of the rotating seat 12. In spite of such an advantage in connection with the capacity, a turning part "A", such as a screwdriver tip, can not be easily moved upward along the relatively steep surface with an inclination of 30 degrees. In light of the efficiency of upward movement of the turning part "A" of a hand tool along the inclined face 112A of the urging blocks 111, a preferred inclination of the inclined face 112A is 45 degrees, as shown in FIG. 4C. In another words, the inclination of 45 degrees is a compromise between the inclination of 60 degrees and the inclination of 30 degrees.

Figure 5:
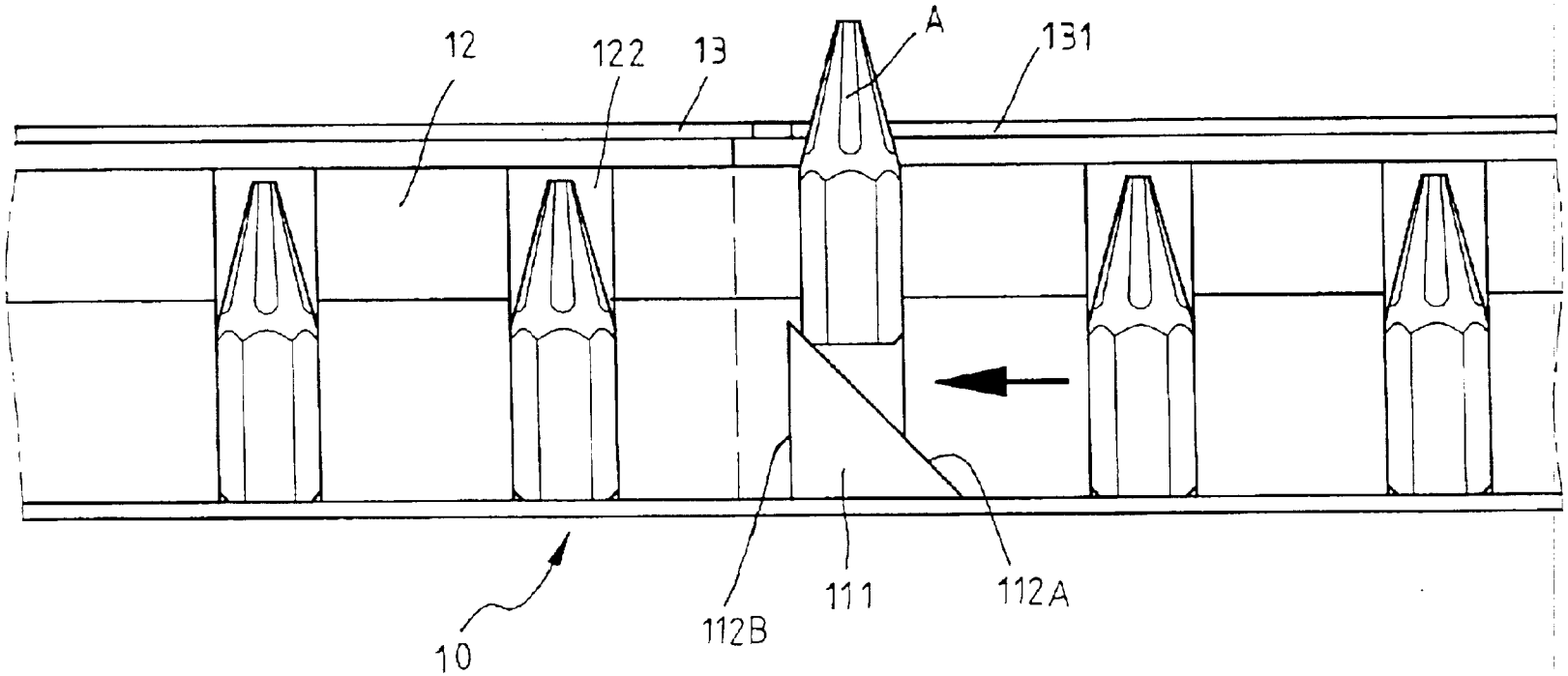
FIG. 5 shows a schematic plan view of the first preferred embodiment of the present invention at work such that a turning part is urged to jut out of the retaining slot.
Figure 6:
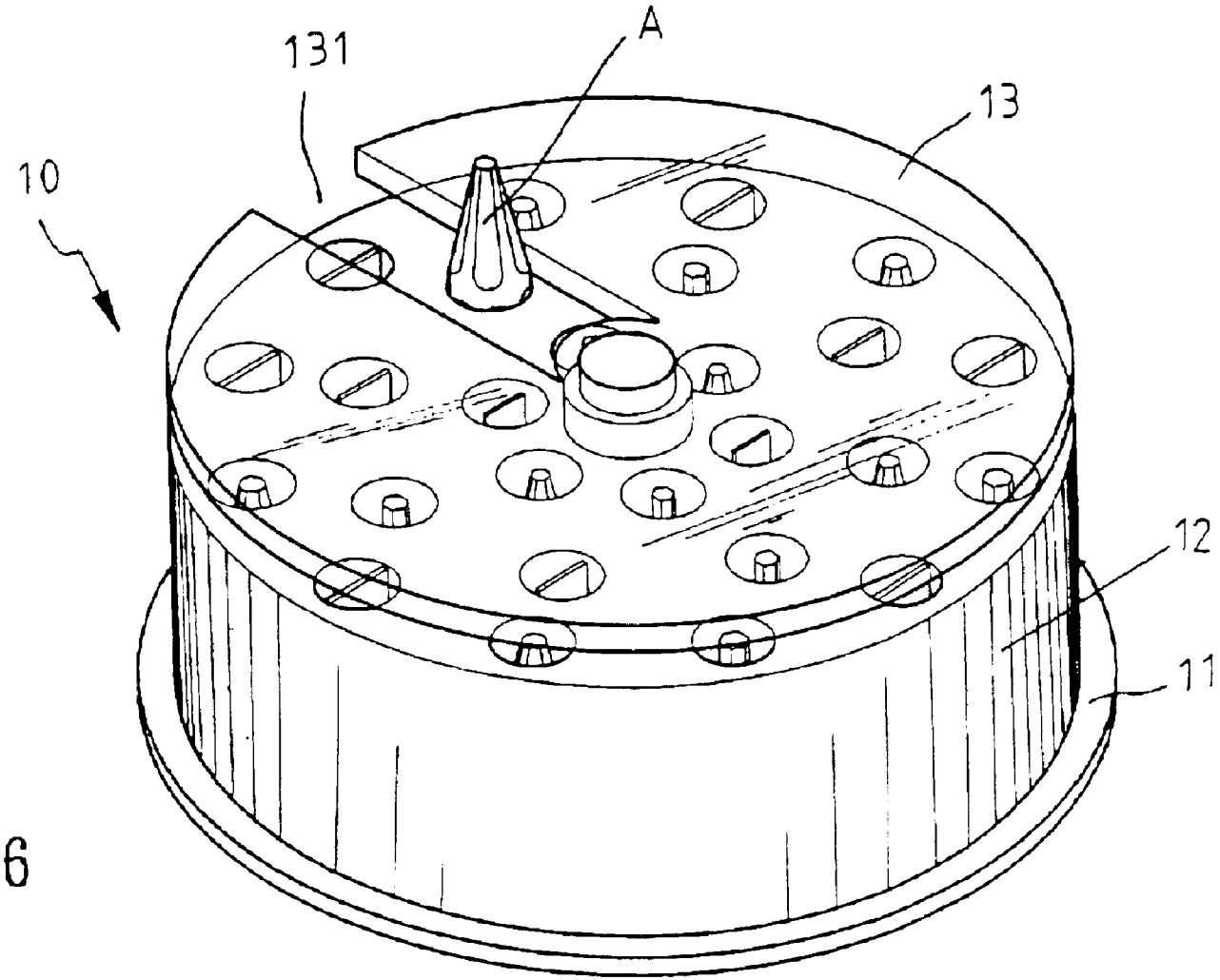
FIG. 6 shows a perspective view of the first preferred embodiment of the present invention.
Figure 7:
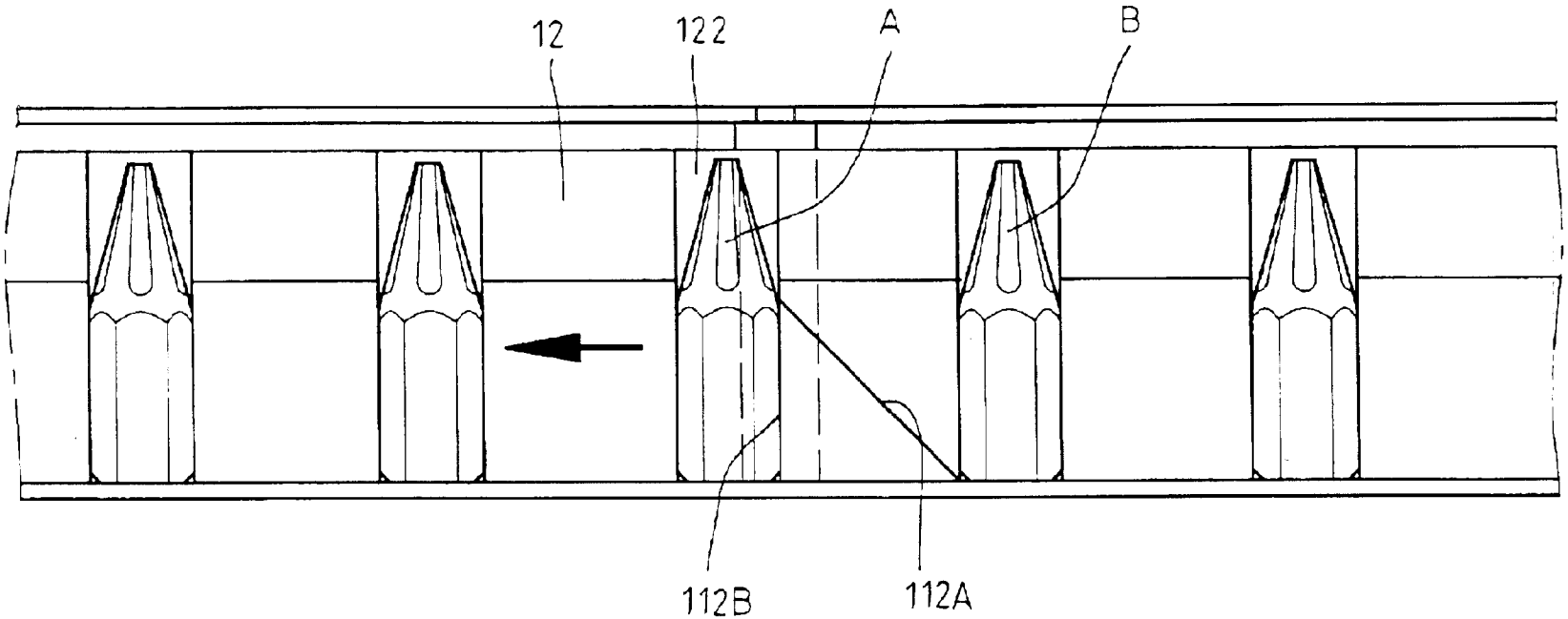
FIG. 7 shows a schematic plan view of the first preferred embodiment of the present invention at work such that a turning part is dropped back into place in the retaining slot.

As illustrated in FIG. 5, when the rotating seat 12 is turned in relation to the base 11, the turning part "A" of the hand tool is moved upward along the inclined face 112A of the urging block 111 such that the turning part "A" is partially jutted out of the retaining slot 122, and that the turning part "A" can be removed from the rotating seat 12 via the through slot 131 of the cover 13, as shown in FIG. 6. In the event that the turning part "A" referred to above is not a desired one, the rotating seat 12 is turned again so as to cause the turning part "A" to drop back into the retaining slot 122 from the top edge of the inclined face 112A, as illustrated in FIG. 7. In the meantime, another turning part "B" of the hand tool is moved upward along the inclined face 112A. If the rotating seat 12 is turned in reverse, the turning part "A" of the hand tool can be raised again along the inclined face 112A.

Figure 8:
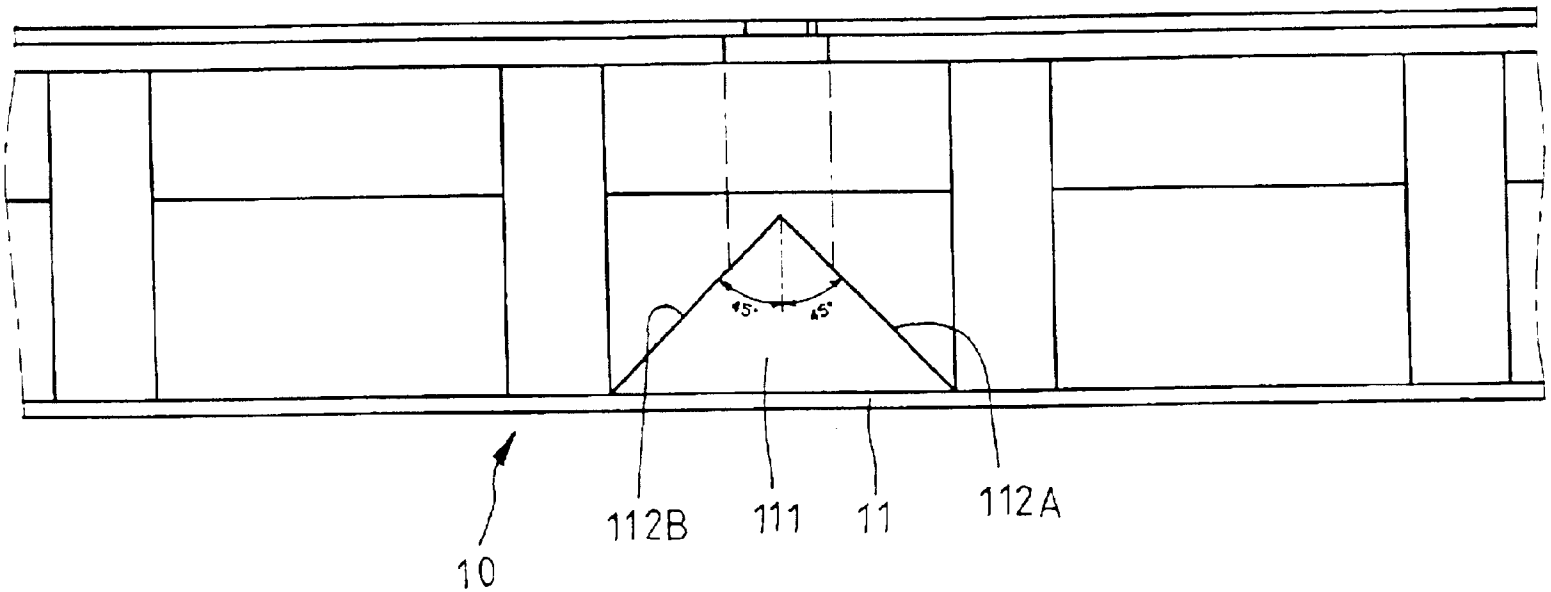
FIG. 8 shows a partial schematic view of a second preferred embodiment of the present invention.
Figure 9:
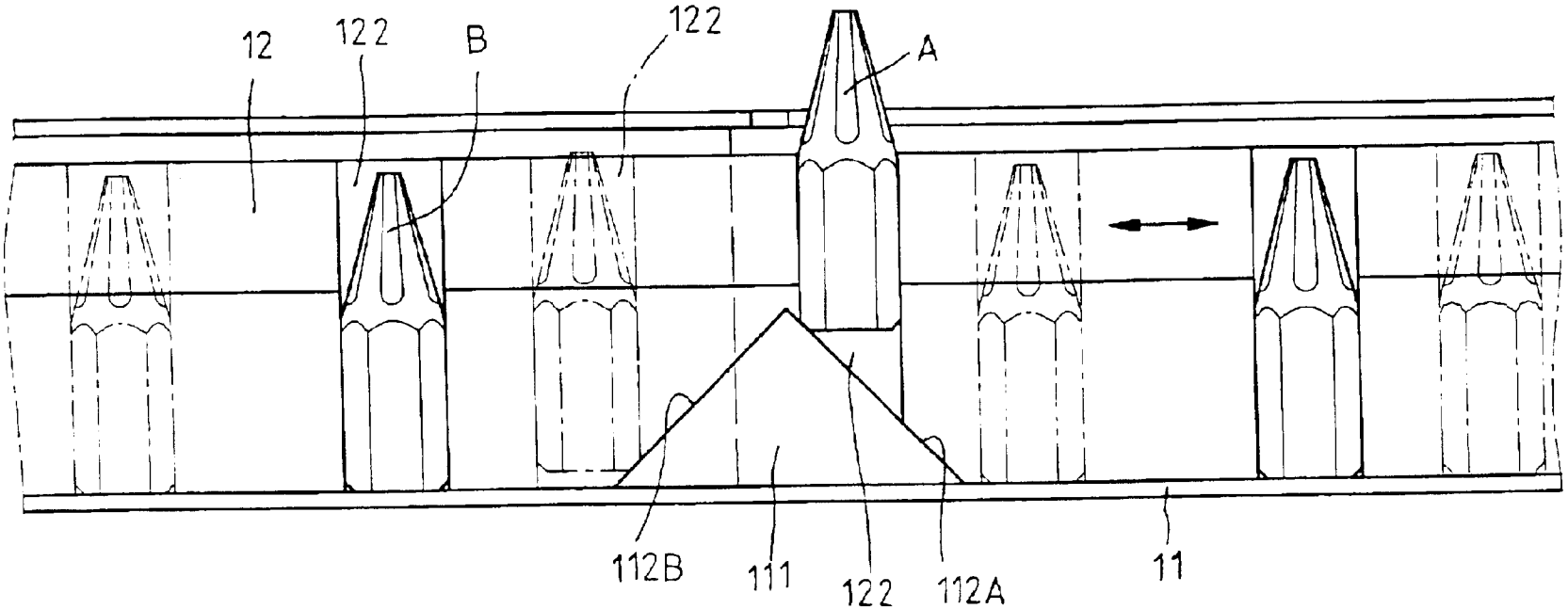
FIG. 9 shows a schematic plan view of the second preferred embodiment of the present invention at work.

As shown in FIGS. 8 and 9, a second preferred embodiment of the present invention is basically similar in construction to the first preferred embodiment described above, with the difference being that the former comprises a plurality of urging blocks 111 which are provided with a first inclined face 112A and a second inclined face 112B corresponding in inclination to the first inclined face 112A. Both the first inclined face 112A and the second inclined face 112B have an inclination of 45 degrees. In operation, the rotating seat 12 is so turned that the turning part "A" of the hand tool is moved along the first inclined face 112A to jut out of the rotating seat 12. In the event that the turning part "A" moves past the top edge of the first inclined face 112A, the turning part "A" moves downward along the second inclined face 112B so as to be kept in the retaining slot 122. If the rotating seat 12 is turned in reverse, another turning part "B" of the hand tool is caused to move upward along the second inclined face 112B to jut out of the rotating seat 12.

As shown in FIGS. 10–13, a third preferred embodiment of the present invention comprises a housing 20 and a sliding seat 22 which is slidably disposed in the housing 20 such that the seat 22 can be drawn out and then pushed back into place. The third preferred embodiment of the present invention may be the handle of a hand tool, such as screwdriver.

Figure 11:
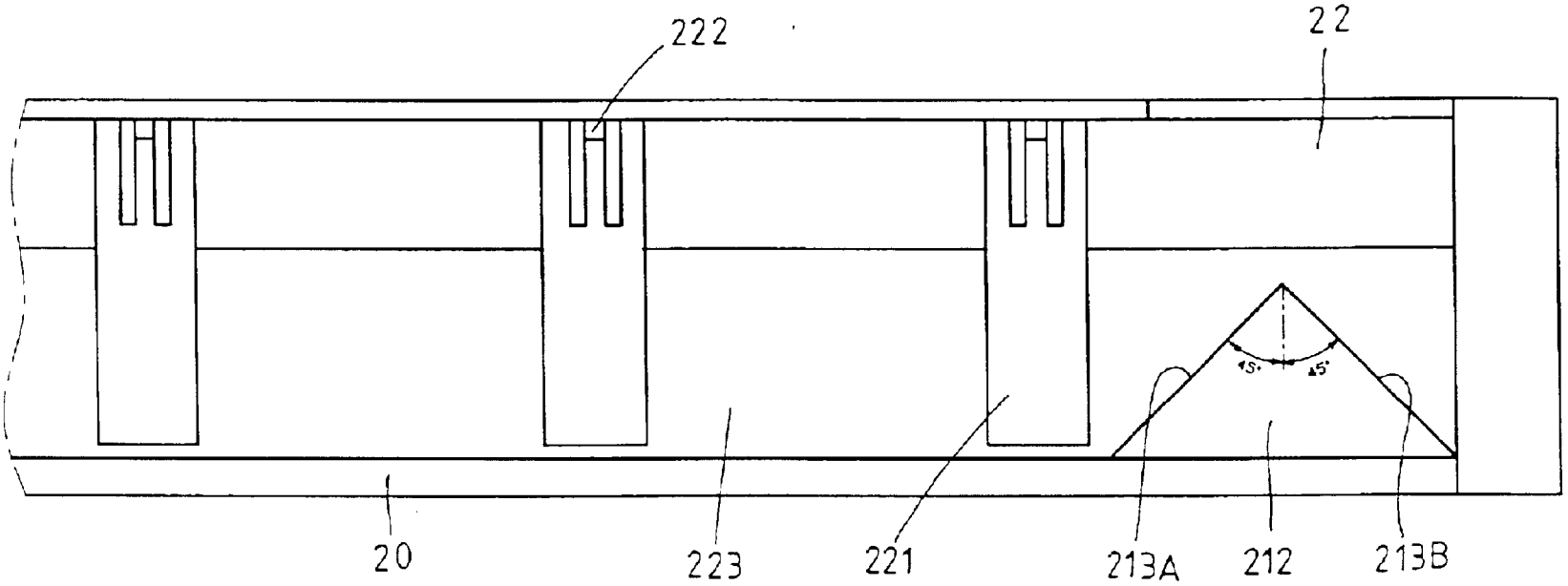
FIG. 11 shows a longitudinal sectional view of the third preferred embodiment of the present invention in combination.

The housing 20 is of a hollow cylindrical construction and is provided in an inner bottom wall 211 of a hollow interior 21 thereof with an urging block 212 of a triangular construction. The urging block 212 has a first inclined face 213A and a second inclined face 213B corresponding in inclination to the first inclined face 213A. Both the first inclined face 213A and the second inclined face 213B have an inclination of 45 degrees, as shown in FIG. 11. The housing 20 is further provided in the side wall of an open end thereof with a through slot 214 of a predetermined length and extending along the longitudinal direction of the housing 20.

Figure 10:
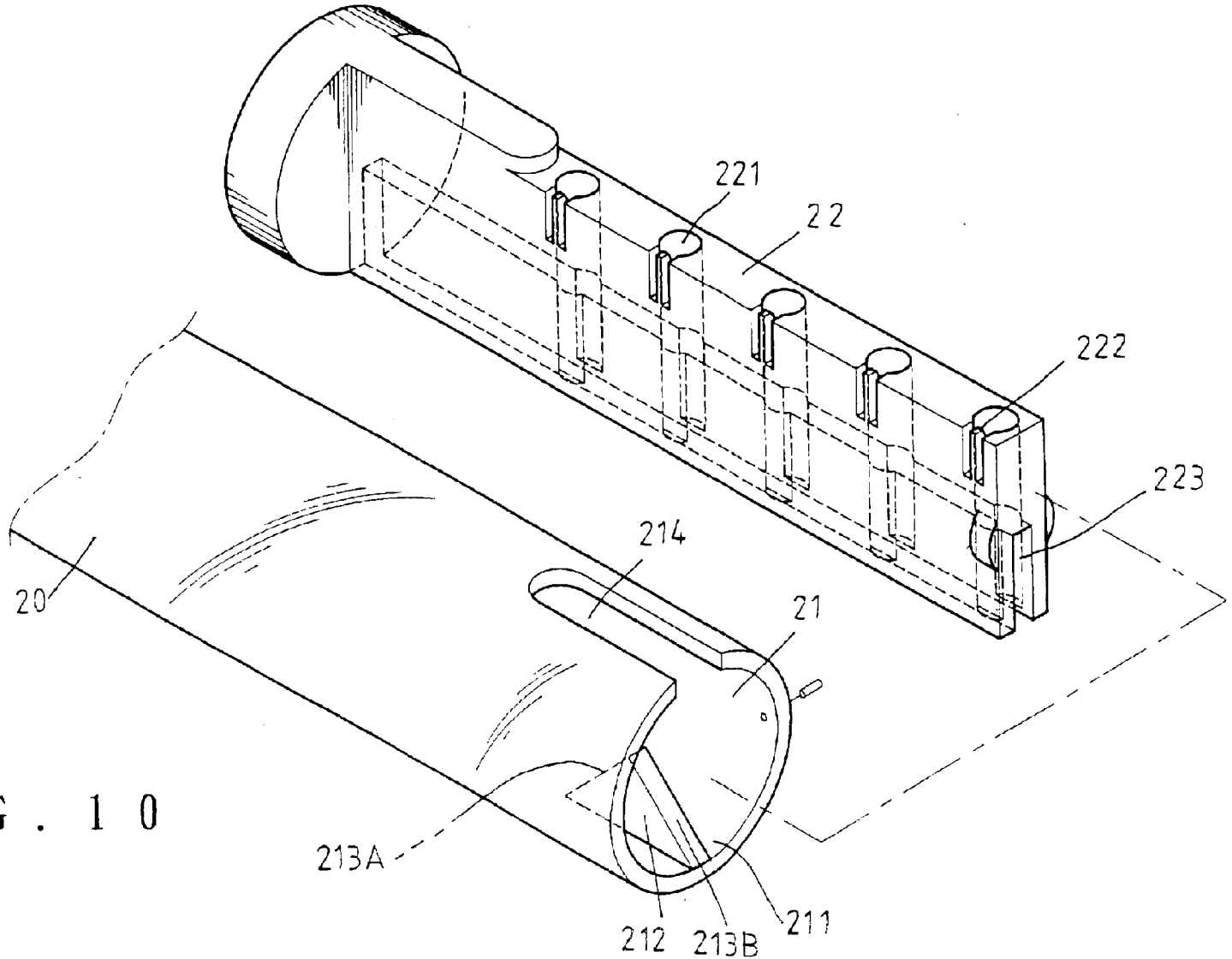
FIG. 10 shows a partial exploded view of a third preferred embodiment of the present invention.
Figure 12:
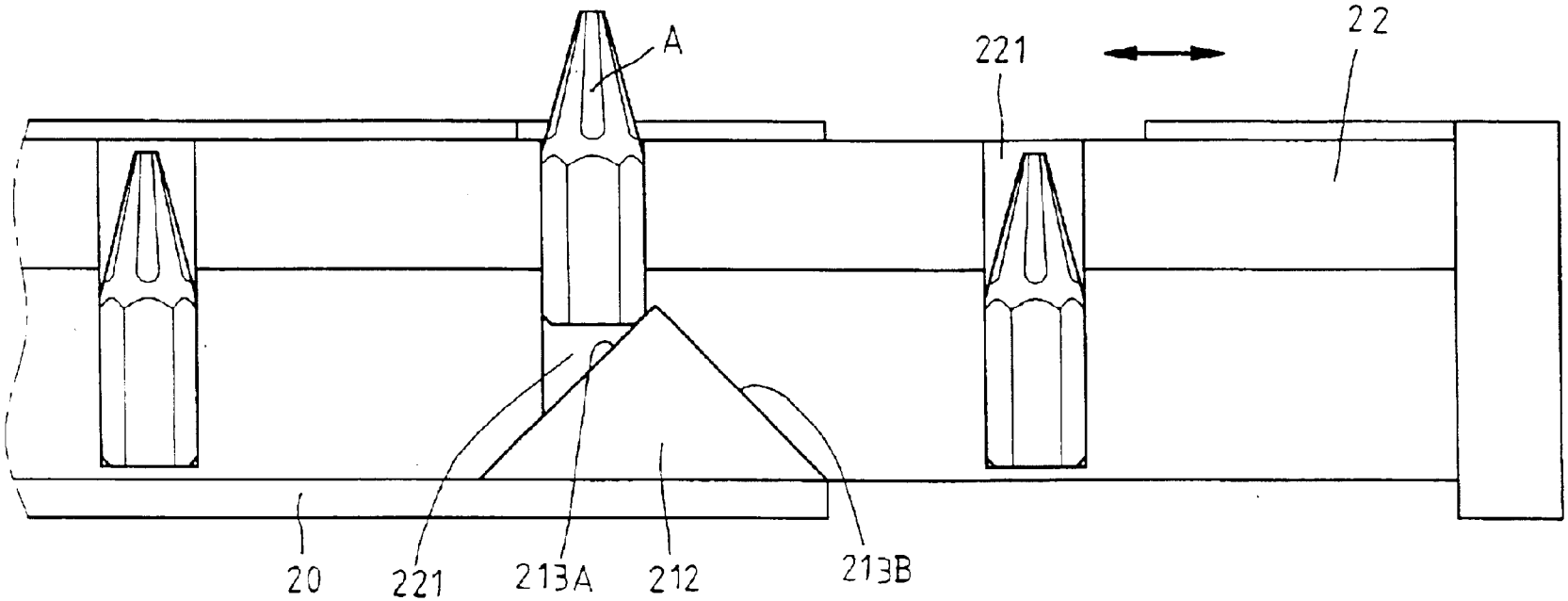
FIG. 12 shows a longitudinal sectional view of the third preferred embodiment of the present invention at work.
Figure 13:
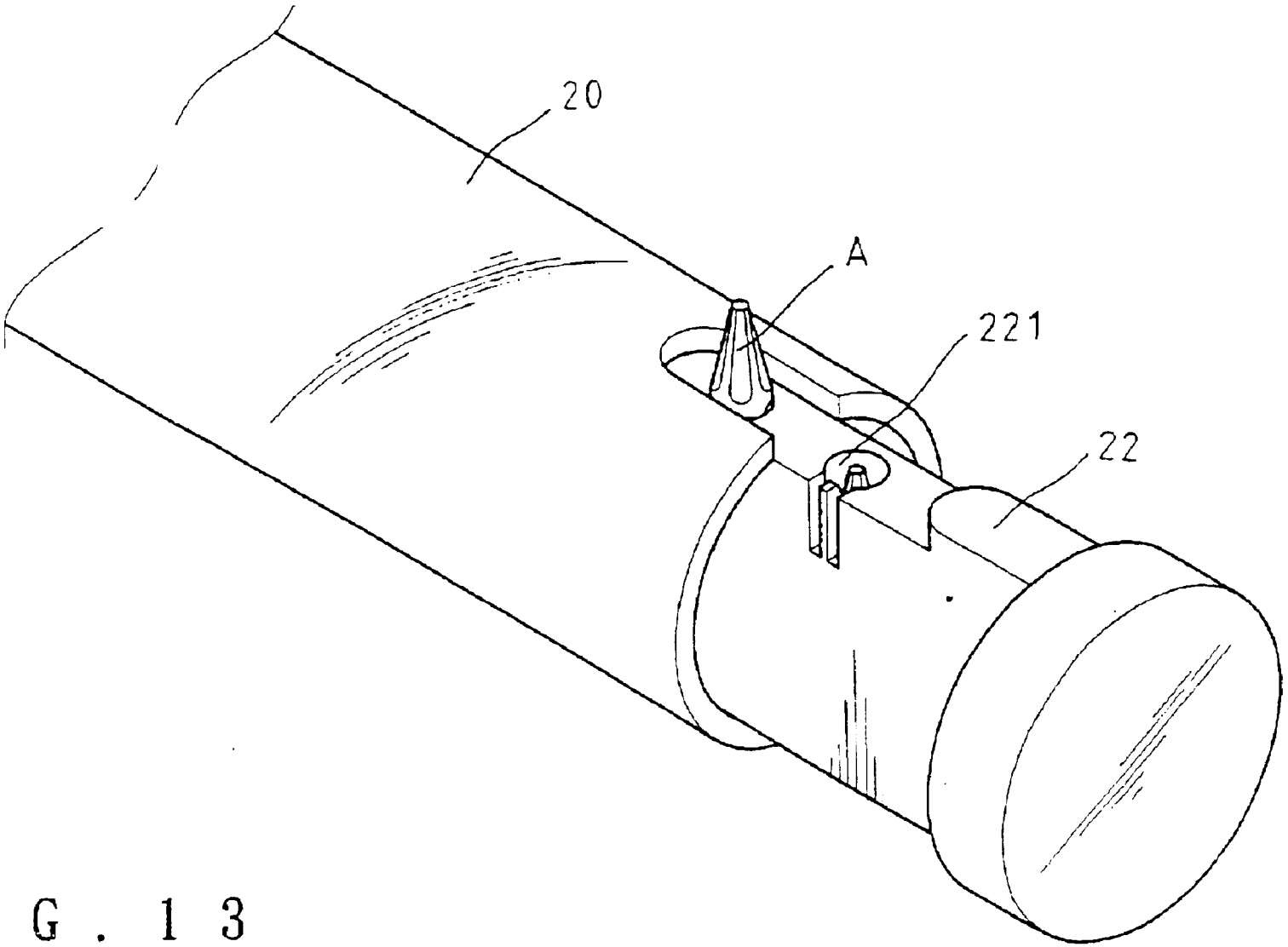
FIG. 13 shows a perspective view of the third preferred embodiment of the present invention.

The sliding seat 22 is slidably disposed in the hollow interior 21 of the housing 20 and is provided with a series of retaining slots 221 and an insertion slot 223 in communication with the retaining slots 221. The insertion slot 223 is corresponding in location to the urging block 212 of the housing 20. The retaining slots 221 are used to hold a plurality of turning parts "A" of a hand tool, as shown in FIGS. 12 and 13. The turning parts "A" are screwdriver tips, whereas the housing 20 is the handle of a screwdriver. The retaining slots 221 are provided at a top end with a position confining rib 222, as shown in FIGS. 10 and 11.

In operation, as the sliding seat 22 is drawn out, the screwdriver tip "A" comes in contact with the urging block 212, as shown in FIG. 12, such that the tip "A" is pushed by the first inclined face 213A of the urging block 212 to move upward to jut out of the retaining slot 221 of the sliding seat 20, thereby enabling the tip "A" to be easily removed from the storage device via the through slot 214 of the housing 20, as illustrated in FIG. 13. The operating mechanism of the third preferred embodiment of the present invention resembles that of the first preferred embodiment of the present invention. As the tip "A" moves beyond the top edge of the first inclined face 213A of the urging block 212, the tip "A" moves downward along the second inclined face 213B to be kept in the retaining slot 221. As the sliding seat 22 is pushed back into place in the housing 20, the tip "A" is caused to move upward along the second inclined face 213B. As the tip "A" moves beyond the top edge of the second inclined face 213B, the tip "A" moves downward along the first inclined face 213A to be kept in the retaining slot 221.

The embodiments of the present invention described above are to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A storage device for keeping the turning parts of a hand tool, said storage device comprising:

a base provided at the center of an upper side thereof with an upright shaft of a length, said base further provided in the upper side thereof with a plurality of urging blocks, each having an inclined face and a vertical face;

a rotating seat provided at a center with a shaft hole and rotatably mounted on said base such that said shaft hole of said rotating seat is fitted with said upright shaft of said base, said rotating seat further provided with a series of retaining slots and insertion slots in communication with said retaining slots, said retaining slots being used for keeping the turning parts of the hand tool, said insertion slots being corresponding in location to said urging blocks of said base; and a cover provided at a center with a through hole and mounted rotatably on said rotating seat such that said through hole is fitted rotatably with a top end of said upright shaft of said base, said cover further provided with a through slot corresponding in location to said retaining slots of said rotating seat;

the turning parts of the hand tool being urged by said urging blocks of said base to move upward along said inclined faces of said urging blocks to jut out of said retaining slots of said rotating seat at such time when said rotating seat is turned in relation to said base.

2. The storage device as defined in claim 1, wherein said inclined face of said urging blocks of said base has an inclination ranging from 30 to 60 degrees; wherein said vertical faces of said urging blocks are identical in height to one another.

3. The storage device as defined in claim 2, wherein said inclined face of said urging blocks has an inclination of 45 degrees.

4. A storage device for keeping the turning parts of a hand tool, said storage device comprising:

a hollow cylindrical housing of a length and provided in an inner bottom wall thereof with an urging block, said urging block having a first inclined face and a second inclined face corresponding in inclination to said first inclined face, said housing further provided with a through slot of a length and extending along a longitudinal direction of said housing; and a sliding seat provided with a series of retaining slots, and an insertion slot in communication with said retaining slots, said retaining slots being used for keeping the turning parts of the hand tool wherein said sliding seat is slidably disposed in said housing such that said insertion slot is corresponding in location to said urging block of said housing, and that one of the turning parts of the hand tool is caused to move upward along said first inclined face of said urging block so as to jut out of said retaining slot at the time when said sliding seat is drawn out of said housing, and further that one of the turning parts is caused to move upward along said second inclined face of said urging block at the time when said sliding seat is pushed back into place.

5. The storage device as defined in claim 4, wherein said first inclined face and said second inclined face of said urging block have an inclination of 45 degrees.

6. A storage device for keeping the turning parts of a hand tool, said storage device comprising:

a hollow cylindrical housing of a length and provided in an inner bottom wall thereof with an urging block, said urging block having a first inclined face and a second inclined face corresponding in inclination to said first inclined face, said housing further provided with a through slot of a length and extending along a longitudinal direction of said housing; and a sliding seat provided with a series of retaining slots, and an insertion slot in communication with said retaining slots, said retaining slots being used for keeping the turning parts of the hand tool wherein said sliding seat is slidably disposed in said housing such that said insertion slot is corresponding in location to said urging block of said housing, and that one of the turning parts of the hand tool is caused to move upward along said first inclined face of said urging block so as to jut out of said retaining slot at the time when said sliding seat is drawn out of said housing, and further that one of the turning parts is caused to move upward along said second inclined face of said urging block at the time when said sliding seat is pushed back into place;

further wherein said retaining slots of said sliding seat are provided at a top end with a position confining rib.

* * * * *